United States Patent [19]

DiLeo

[11] 4,124,209

[45] Nov. 7, 1978

[54] TENNIS RACQUET WITH INSERT

[76] Inventor: Philip F. DiLeo, P.O. Box 388, Boulder, Colo. 80302

[21] Appl. No.: 678,733

[22] Filed: May 13, 1976

Related U.S. Application Data

[63] Continuation-in-part of Ser. No. 626,510, Oct. 28, 1975, which is a continuation-in-part of Ser. No. 567,922, Apr. 14, 1975, abandoned.

[51] Int. Cl.[2] ..... A63B 49/02

[52] U.S. Cl. ..... 273/73 L

[58] Field of Search ..... 273/73 R, 73 C, 73 D, 273/73 E, 73 L, 74

[56] References Cited

U.S. PATENT DOCUMENTS

| | | | |
|---|---|---|---|
| 1,832,298 | 11/1931 | Greenspan | 273/73 C X |
| 2,004,609 | 6/1935 | Johnston | 273/73 L X |
| 3,689,093 | 9/1972 | Meland | 273/73 R X |
| 3,843,121 | 10/1974 | Edlefsen | 273/73 L |
| 3,891,211 | 6/1975 | Diefenbach | 273/73 L |

FOREIGN PATENT DOCUMENTS

| | | | |
|---|---|---|---|
| 151,916 | 6/1953 | Australia | 273/73 L |
| 1,903,722 | 8/1970 | Fed. Rep. of Germany | 273/73 C |
| 718,914 | 1/1933 | France | 273/74 |
| 1,489,007 | 6/1967 | France | 273/73 C |
| 307,090 | 4/1933 | Italy | 273/74 |
| 427,265 | 4/1935 | United Kingdom | 273/74 |
| 1,050,631 | 12/1966 | United Kingdom | 273/74 |

*Primary Examiner*—Richard J. Apley

[57] ABSTRACT

A racquet comprising a frame, an insert which is received in a groove in the head portion of the frame and a locking device in the head or frame portion holding the insert securely to the frame.

2 Claims, 9 Drawing Figures

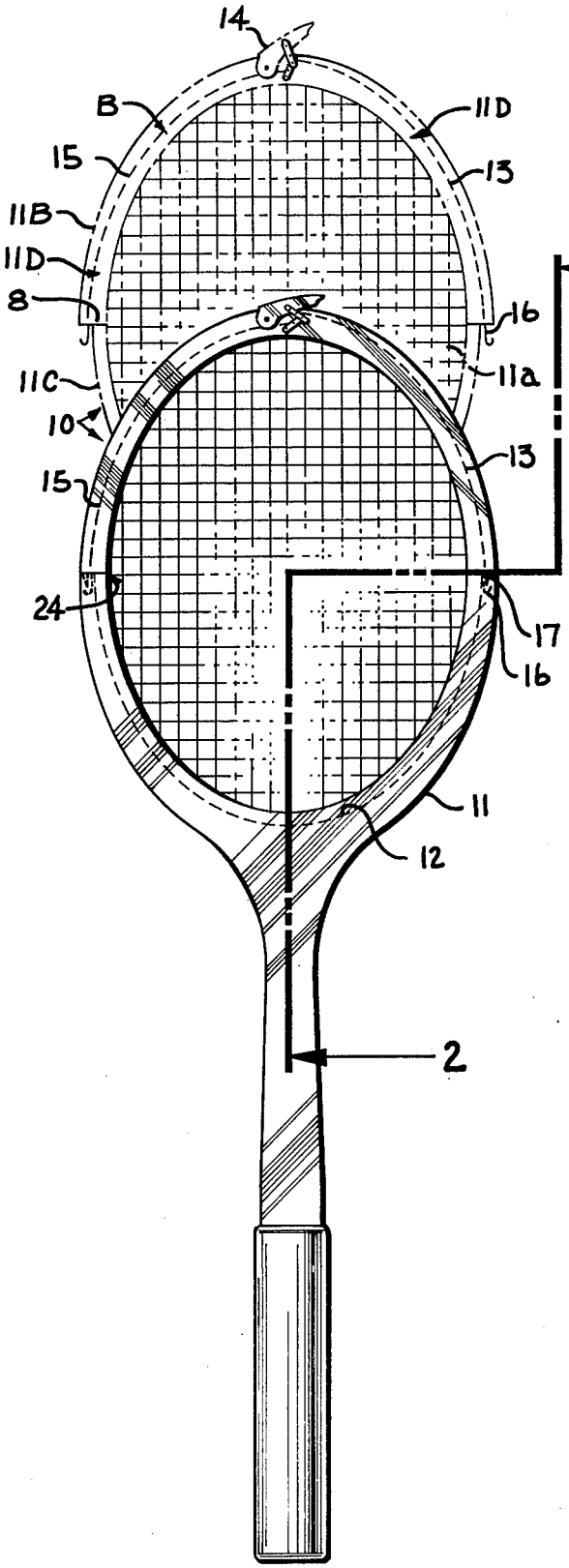
Fig. 1
Fig. 2
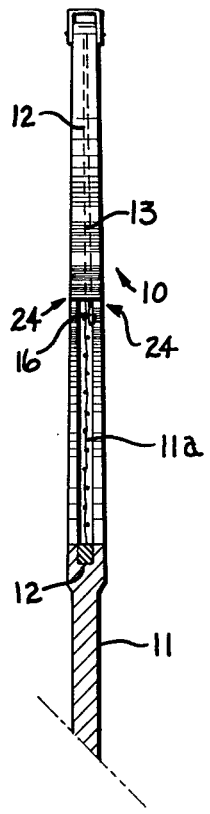
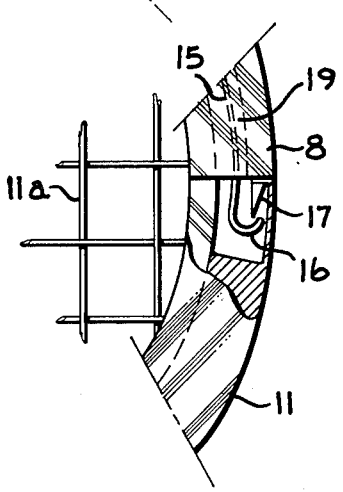
Fig. 3

TENNIS RACQUET WITH INSERT

RELATED APPLICATIONS

The present application is a continuation-in-part of continuation-in-part, Ser. No. 626,510, filed Oct. 28, 1975 in turn is a continuation-in-part of U.S. Patent Application Ser. No. 567,922, filed Apr. 14, 1975, now abandoned.

BACKGROUND OF THE INVENTION (1) Field of the Invention

The present invention relates to the field of sporting goods, more specifically to racquets for tennis and other like games.

(2) Description of the Prior Art

U.S. Pat. No. 3,707,288 teaches a racquet having a removable playing surface secured to a frame member by screws which require a coin or tool for tightening. U.S. Pat. No. 2,004,609 shows a somewhat similar racquet having a removable playing surface held in place by several screws which can be tightened with a key. U.S. Pat. No. 1,832,290 teaches a tennis racquet having a demountable handle or shank.

None of the above prior art teaches a tennis racquet having removable and interchangeable playing surfaces which are secured readily without the use of any tools and having a solid one piece racquet frame.

SUMMARY OF THE INVENTION

General Statement of the Invention

According to the present invention, demountable, replaceable and interchangeable playing surfaces are provided in a tennis racquet or the like.

Utility of the Invention

The present invention provides a tennis or similar racquet insert which can be removably secured within a solid one-piece tennis racquet frame. The invention provides a tennis racquet insert which enables a tennis player to switch between gut and nylon or other playing surfaces, simply by substituting one racquet insert for another. The invention avoids the discomfort previously experienced with split racquets of the prior art. The racquets of the invention can be simple in design, inexpensive to manufacture, rugged in construction, and efficient in operation, requiring no tools for interchange of or securing of playing surfaces.

DESCRIPTION OF THE DRAWINGS

FIG. 1 is a plan view of the present invention showing the insert in position within the racquet frame and as it is partially removed from the racquet frame.

FIG. 2 is a cross-sectional view taken along lines 2—2 of FIG. 1.

FIG. 3 is an enlarged fragmentary plan view showing a retractable hooking means within the insert and a lug means within the racquet frame.

DESCRIPTION OF THE PREFERRED EMBODIMENTS OF THE RACQUET

Figure 4:
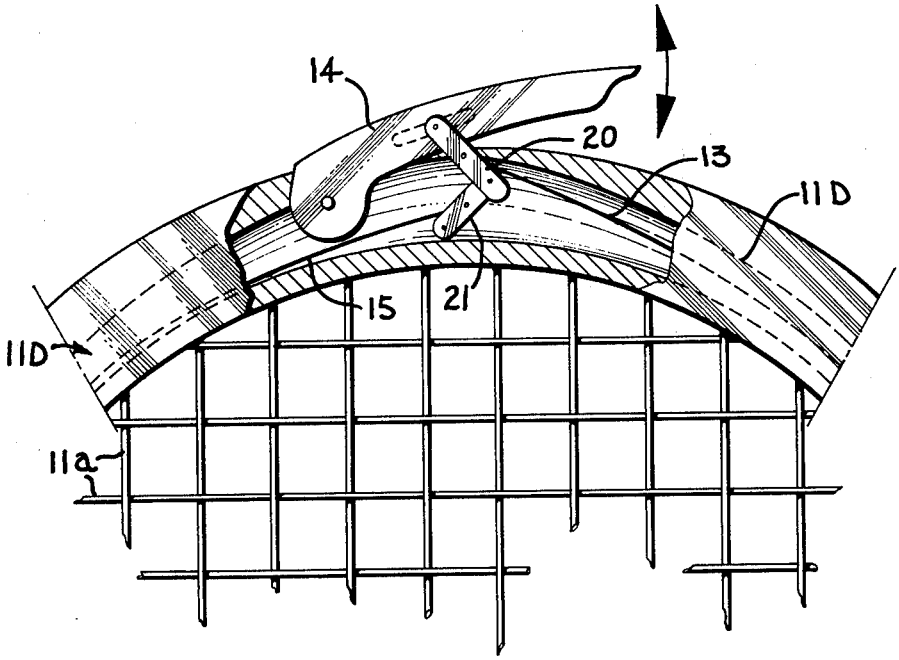
FIG. 4 is an enlarged fragmentary cut-away view showing a typical spring lever for use in activating the retractable hooking means.

Referring to FIG. 1, tennis racquet insert 10 is shown as including a cord mesh 11A insert head 11B and a rim portion 11C received removably within an arcuate groove opening 12 of the frame 11 of the racquet. A flange portion 8 of the insert head 11B having a hollow channel 11D within the insert head 11B, when inserted, abuts with the abutments 24 of frame 11. A spring lever 14 mounted flush within the insert head 11B provides locking and unlocking means for insert 10 for retracting and extending hooks 16. The spring lever 14 is connected to wires 13 and 15 running within the hollow channels 11D of insert head 11B. Wires 13 and 15 are terminated by the extending hooks which engage the retaining lugs 17 secured fixedly within the head 11 of the racquet frame.

The spring lever pivots to cause extending and retracting of wires 13 and 15 which terminate in retaining hooks 16.

Alternately, the spring lever means, wire portion and hooks can all be mounted on the frame member and the retaining lugs can be mounted on the removable insert.

In operation, the pivotal spring lever 14 is merely opened extending the wires 13 and 15 through slanted guide 19 to disengage hooks 16 from lugs 17 located within the racquet frame. The insert 10 is then easily removed from the head 11 by sliding outward. A new insert having different playing surface material or configuration but otherwise being similar to insert 10 can then be inserted in the racquet frame and secured after insertion by merely closing spring lever 14 to retract hooks 16.

FIG. 4 shows a typical spring lever device for use with the invention consisting of a pivoted lever 14 which is cup-shaped so that, when closed, it has recessed within it two pivoted takeup members 20 and 21. Pivoted takeup members 20 and 21 are connected, respectively, to wires 13 and 15 and serve to retract these wires when lever 14 is swung down flush with the exterior surface of the insert head 11B. Many other similar takeup devices can be substituted for this particular configuration.

Figure 5:
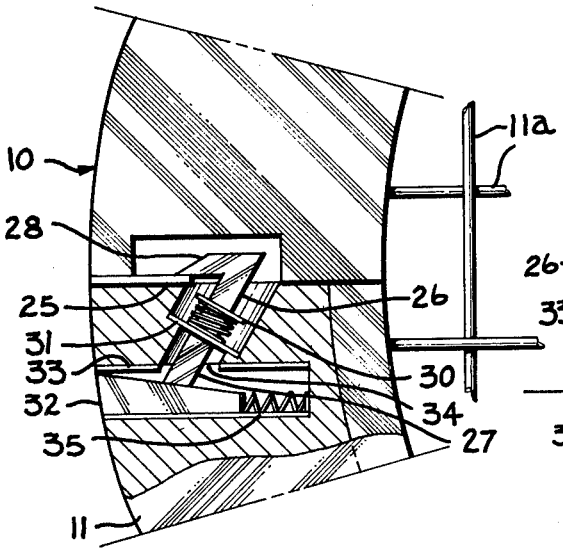
FIG. 5 is an enlarged fragmentary cut-away view of an alternative embodiment of this invention having a latching engagement wherein a lug on a flange portion of the insert engages with a retractable latching means located within the frame of the racquet. The view shows the latching engagement in the latched position.

Referring to FIG. 5, tennis racquet insert 10 with a lug 25 is shown in the locked position with a locking latch 26 having a stem end 27 and a hook end 28. The locking latch 26 is biased against the head lug 25 with a biasing means such as a spring in tension between a locking latch ring 30 which is fixedly attached to the stem end 27 and a plate 31 which is fixedly mounted to the racquet frame 11. The plate 31 has an opening through which the stem end 27 can move. The biasing action of the spring causes the end of the stem end 27 to bias itself against a push botton 32 located in a push botton guide 33 in the head 11 of the racquet. The push botton guide 33 has an opening 34 through which the stem end 27 is free to move in its biasing action. The push botton 32 is biased in the locked position by a biasing means such as a spring 35.

Figure 6:
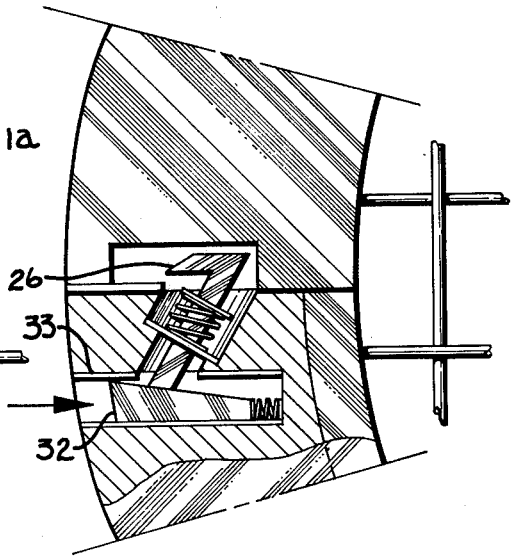
FIG. 6 shows the latching engagement in the unlatched position.

FIG. 6 shows the locking latch 26 in the unlocked position when the push botton 32 is in the depressed position in the push botton guide 33.

Figure 7:
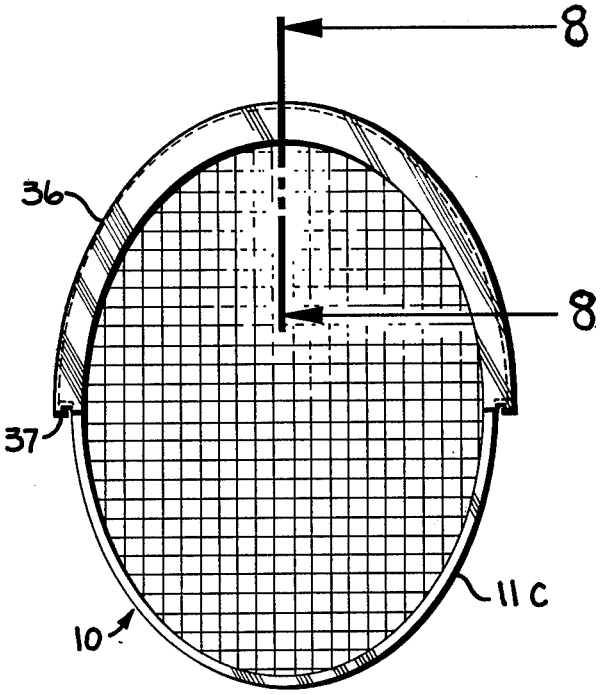
FIG. 7 is a plan view of the insert showing a lug built into flange portions of the insert for receiving the retractable latching means. A compression rim for assisting in holding the insert tightly within the racquet frame is shown forming a part of the insert.

FIG. 7 shows another embodiment of this invention wherein the insert head 11B has a concave shaped compression ring 36. The compression ring 36 is shown encompassing the insert head. The compression ring 36 is shown equipped with a lug 37 for engaging the locking latch 26 of FIG. 5. The lug 37 can be so adapted and arranged that it operates in conjunction with the head lug 25 of FIG. 5 or the lug 37 can be substituted for the head lug 25.

Figure 8:
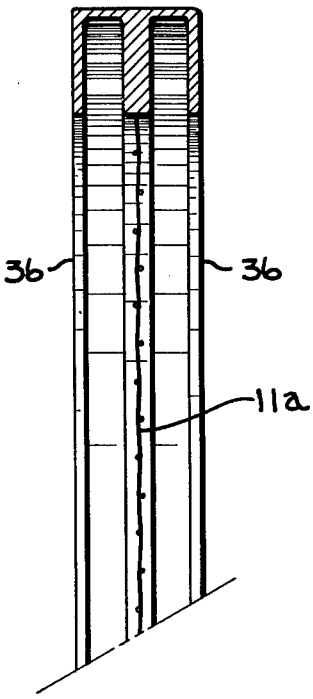
FIG. 8 is a cross-sectional view taken along lines 8—8 of FIG. 7 showing the compression ring in operative position around the racquet frame to compress the insert between the sides of the frame, wherein said compression rim forms an upper part of the insert and compresses the two sides of the frame against the insert's rim portion.
Figure 9:
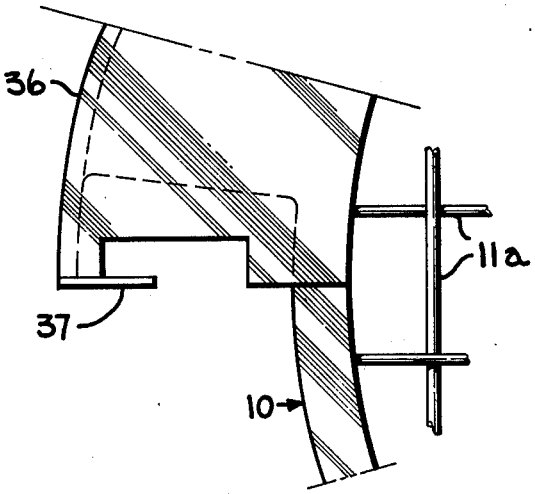
FIG. 9 is an enlarged view showing the end of the compression ring forming the lug on the flange portion of the insert.

FIG. 8 is a cross-sectional view taken along lines 8—8 of FIG. 7 showing the insert in the arcuate opening between the sides of the racquet insert head. The concave compression ring 36 is shown in the compressing position about the racquet insert head.

It should be understood that the invention is capable of a variety of modifications and variations which will be made apparent to those skilled in the art by a reading of the specification and these are to be included within the scope of the claims appended hereto.

What I now claim is:

1. A racquet having a replaceable playing surface, said racquet including a frame member having a handle and a head portion, said head portion being provided with an arcuate opening with groove means for receiving an insert, and a racquet insert comprising a rim with suitable playing surface secured fixedly therein, locking latch means acting with lug means to provide locking and unlocking of said insert within the head of said frame portion of the racquet, and wherein said locking latch means comprise hooks biased in a locked position.

2. The combination of claim 1 wherein said hooks engage retaining lug means secured fixedly within the insert whereby when said locking latch means are engaged, the hook portion of the locking latch engage the lug means to secure the insert.

* * * * *